United States Patent [19]

Tomonori

[11] Patent Number: 4,460,280

[45] Date of Patent: Jul. 17, 1984

[54] ALARM SETTING DEVICE FOR TIMEPIECES

[75] Inventor: Sano Tomonori, Saitama, Japan

[73] Assignee: Rhythm Watch Co., Ltd., Tokyo, Japan

[21] Appl. No.: 493,299

[22] Filed: May 10, 1983

[30] Foreign Application Priority Data

May 14, 1982 [JP] Japan ..... 57-70857[U]

[51] Int. Cl.[3] ..... G04B 23/02

[52] U.S. Cl. ..... 368/74; 368/72

[58] Field of Search ..... 368/74, 73, 72, 192–196

[56] References Cited

U.S. PATENT DOCUMENTS 4,212,155 7/1980 Ogihara et al. ..... 368/74

4,376,994 3/1983 Ogihara et al. ..... 368/74

FOREIGN PATENT DOCUMENTS 2823111 7/1978 Fed. Rep. of Germany ..... 368/72

2822538 7/1978 Fed. Rep. of Germany ..... 368/72

*Primary Examiner*—Bernard Roskoski

*Attorney, Agent, or Firm*—Koda and Androlia

[57] ABSTRACT

An alarm setting device includes a time wheel cooperative with the gear train of a timepiece to rotate by one revolution through twelve hours, an alarm setting wheel used to set the alarm setting time, an alarm cam coaxially disposed between the time wheel and the alarm setting wheel for permitting the alarm cam to rotate about and move along the axis, and a cam mechanism acting on the alarm cam to permit the relative rotation between the time wheel and alarm setting wheel when one of these wheels is rotated both in the forward and reverse directions.

3 Claims, 10 Drawing Figures

ALARM SETTING DEVICE FOR TIMEPIECES

BACKGROUND OF THE INVENTION

1. Field of Invention

The present invention relates to an alarm setting device for timepieces and particularly to the improvement of an alarm setting device which is of such a type that an alarm mechanism is activated at a predetermined relative position between a time wheel and an alarm setting wheel and in which the existing time or the alarm setting time at which the alarm sounds can be changed in the opposite directions.

2. Prior Art

There is currently known an alarm setting device of such a type that it comprises a time wheel operably connecting with the gear train of a timepiece and an alarm setting wheel in an alarm setting gear train which is externally operated to set an alarm hand at the desired setting time, the alarm setting device further comprising a cam mechanism which is defined by the time and alarm setting wheels and by which an activating spring defining an alarm contact and the other components can controllably mechanically moved to control the alarm mechanism. In such an arrangement, the rotation of the cam mechanism is permitted only in one direction to constrain the unidirectional rotation to the alarm setting wheel, so that the alarm setting device requires to rotate through twelve-hours rotation once the alarm hand has been moved past the desired setting time. Furthermore, the conventional alarm setting device comprises a ratchet mechanism which is complicated in construction resulting in a large number of parts. If the time hand of the timepiece is rotated in the reverse direction, the alarm setting gear train and hand may be also rotated in the same direction since the alarm setting wheel engages with the time wheel. As a result, the alarm setting time is undesirably changed. In addition, an undesirable torque is transmitted to the entire gear trains so that any damage will take place therein.

SUMMARY OF THE INVENTION

It is an object of the present invention to provide an alarm setting device in which the time hand of a timepiece can be prevented for axially moving even when an alarm mechanism is activated at its alarm setting time and in which the alarm setting time or the existing time can be changed by rotating the alarm setting wheel or the time wheel in the opposite directions.

In order to attain such an object, the present invention provides an alarm setting device comprising a time wheel operably connecting with a timepiece gear train to rotate by one revolution for twelve hours, an alarm setting wheel coaxially disposed relative to the time wheel and which is used to set a desired alarm time, an alarm cam coaxially disposed between the time and alarm setting wheels for it to rotate about and slide along its axis, and an activating spring for urging the alarm setting wheel against the alarm cam, said alarm setting device being characterised by time cam aperture means formed in one of the time wheel face and the alarm can face opposed to the time wheel, time cam projection means formed in the other wheel face for engaging with the time cam aperture means at all times and including sloping surface means formed therein at one end face, alarm cam aperture means formed in one of the alarm setting wheel face and the alarm cam face opposed to the alarm setting wheel, and alarm cam pawl means formed in the other of the alarm setting wheel face and the alarm cam face opposed to the alarm setting wheel for engaging with the alarm cam aperture means, said alarm cam pawl means including sloping surface means formed at one end face, the sloping surface means in said time cam projection means engaging with the end face of said time cam aperture means to axially slide said alarm cam to bring said alarm cam and said alarm cam aperture into disengagement with each other when said time wheel or said alarm setting wheel is rotated in the reverse direction, whereby said time wheel or said alarm setting wheel can be rotated in the opposite directions without any obstruction for changing the alarm setting time.

BRIEF DESCRIPTION OF THE DRAWINGS

The above mentioned and other features and objects of the present invention will become more apparent by reference to the following description taken in conjunction with the accompanying drawings, wherein like reference numerals denote like elements and in which.

DETAILED DESCRIPTION OF THE INVENTION

Figure 1:
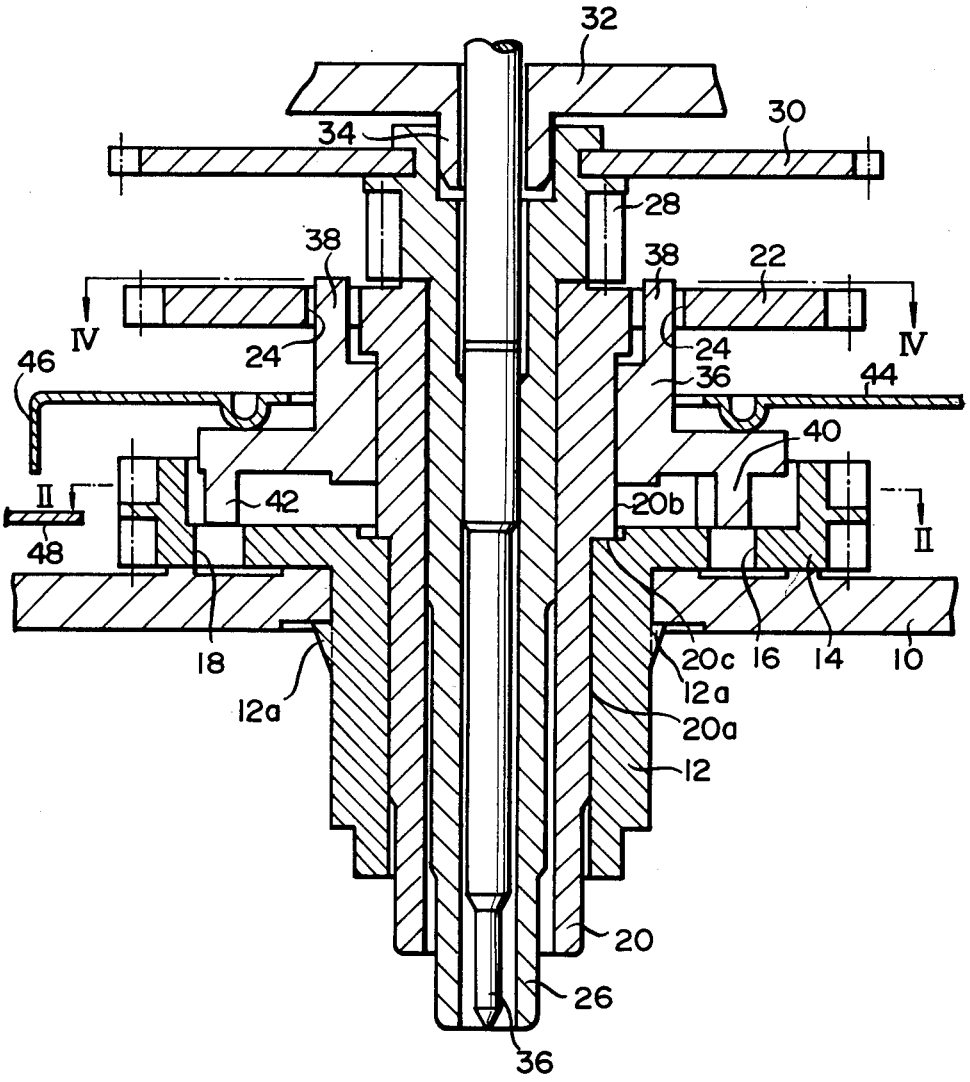
FIG. 1 is a cross-sectional view of one embodiment according to the present invention.
Figure 2:
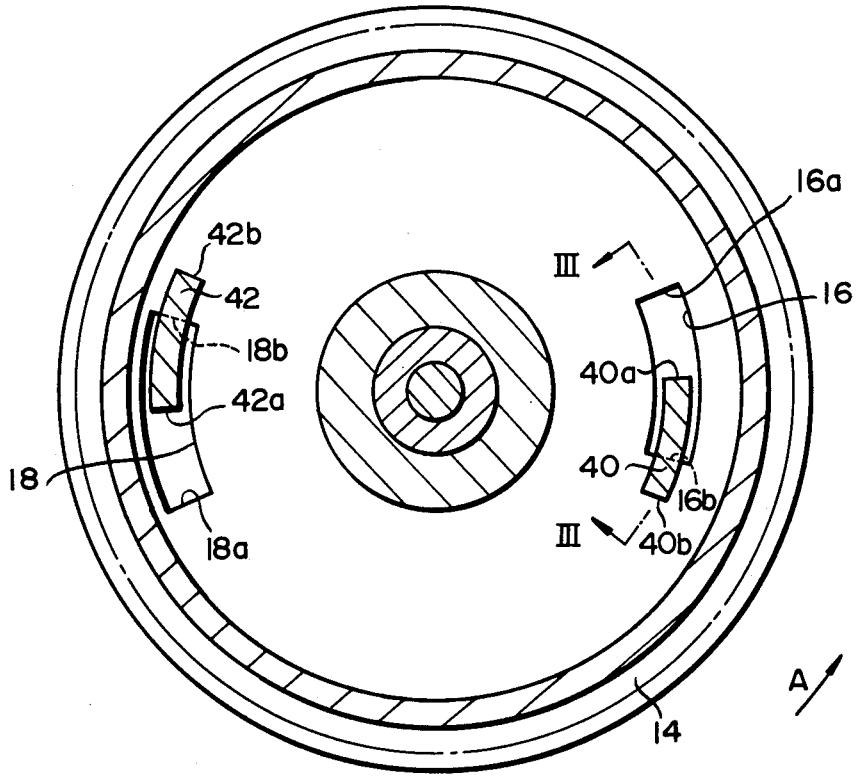
FIG. 2 is a cross-sectional view taken along a line II—II in FIG. 1.

FIG. 1 shows one embodiment of the present invention in which a time wheel and an alarm setting wheel are coaxially disposed relative to a time hand axle. In this embodiment, a mechanism supporting plate 10 supports an alarm setting wheel 14 for permitting it to rotate in the opposite directions. The alarm setting wheel 14 includes an alarm pipe 12 to which an alarm hand can be fixed at the tip thereof. The alarm pipe 12 of the alarm setting wheel 14 is made of an elastomeric material and includes a plurality of projections 12*a* formed therein around the outer periphery thereof. These projections 12*a* engage with the underside of the mechanism supporting plate 10 to locate the latter between the projections and the alarm setting wheel 14. As shown in FIG. 2, the alarm setting wheel 14 includes arcuate alarm cam apertures 16 and 18 formed therethrough at different radius distances from the center of the alarm setting wheel. The alarm setting wheel 14 engages with an alarm transmitting wheel (not shown) and may be rotated by the conventional alarm changing mechanism in the opposite directions through the alarm transmitting wheel.

Figure 4:
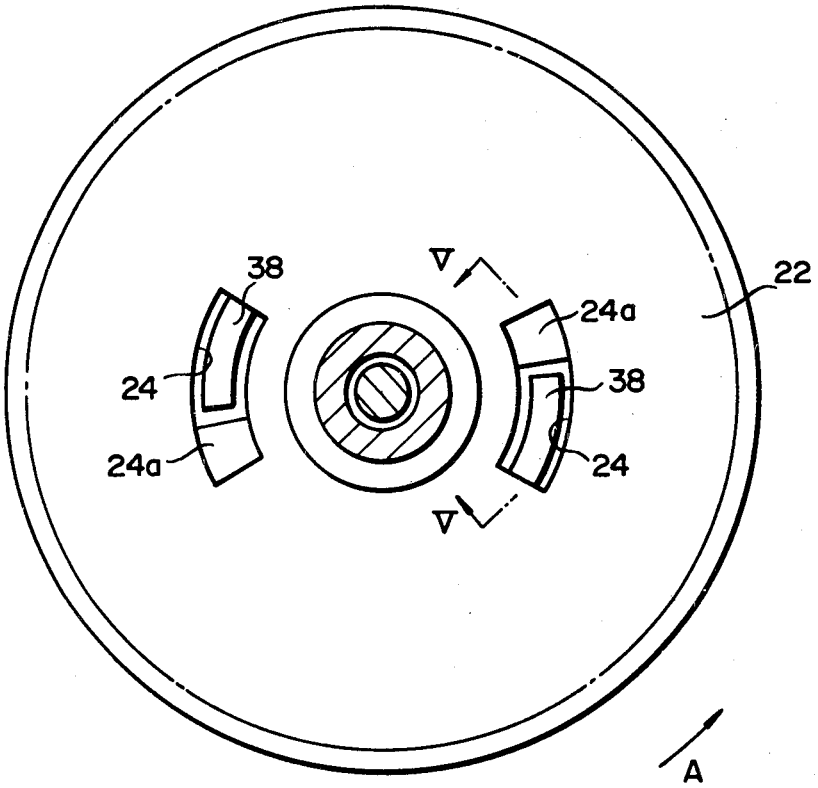
FIG. 4 is a cross-sectional view taken along a line IV—IV in FIG. 1.

The alarm pipe 12 of the alarm setting wheel 14 rotatably receives a time hand pipe 20 to which a time wheel 22 is fixed. As shown in FIG. 4, the time wheel 22 has arcuate time cam apertures 24 formed therethrough at the same radius distance from the center of the time wheel 22. Each of the time cam apertures 24 is formed with a sloping surface 24*a* at the end face of that aperture positioned in the direction shown by arrow A, that is, in the forward direction. The time hand pipe 20 is stepped at the outer periphery to form a reduced diameter portion 20*a* and an enlarged diameter portion 20*b* with a step 20*c* being positioned therebetween. By engaging the step portion 20*c* with the alarm setting wheel 14, the time wheel 22 is constrained against the axial movement in the downward direction as viewed in FIG. 1.

The time hand pipe 20 rotatably receives a minute hand pipe 26 with which a minute hand pinion 28 is formed as a unit. A minute hand wheel 30 is snappedly connected to the top of the minute hand pipe 26. The minute hand pipe 26, minute hand pinion 28 and minute hand wheel 30 are rotatably supported by a minute hand pipe receiver 34 extending inwardly from a floor plate 32. The minute hand pipe 26 rotatably receives a second hand axle 36.

An alarm cam 36 is disposed between the time wheel 22 and the alarm setting wheel 14 and rotatably supported by the enlarged diameter portion 20*b* of the time hand pipe 20 while being permitted to move axially on the enlarged diameter portion 20*b*.

Figure 3:
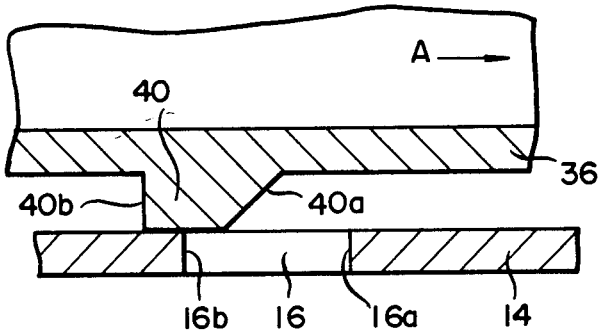
FIG. 3 is a cross-sectional view taken along a line III—III in FIG. 1.

The alarm cam 36 is formed at one side with two time cam projections 38 capable of engaging with the corresponding time cam apertures 24 in the time wheel 22. The other side of the alarm cam 36 includes alarm pawls 40 and 42 formed therein and adapted to engage with the corresponding alarm cam apertures 16 and 18 in the alarm setting wheel 14. The alarm pawls 40 and 42 are substantially identical each other in shape. Therefore, the alarm pawl 40 will be only described. As shown in FIG. 3, the alarm pawl 40 is formed with a sloping surface 40*a* at the end face thereof positioned in the direction shown by arrow A, that is, in the forward direction. With the sloping surface 40*a* riding up on a vertical end face 16*a* of the alarm cam aperture 16, the alarm pawl 40 can disengage with the alarm cam aperture 16. The opposite end face of the alarm pawl 40 also forms a vertical surface 40*b* which is adapted to engage with the other vertical end face 16*b* of the alarm cam aperture 16 when the alarm pawl 40 drops in the alarm cam aperture 16.

Figure 5:
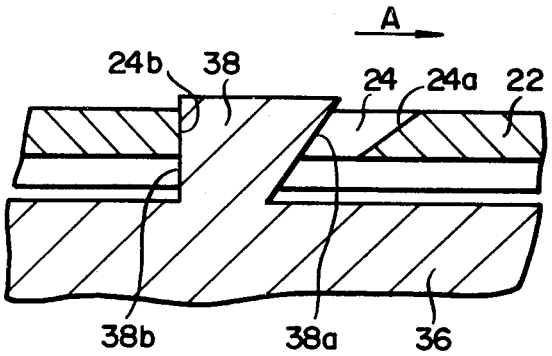
FIG. 5 is a cross-sectional view taken along a line V—V in FIG. 1.
Figure 6:
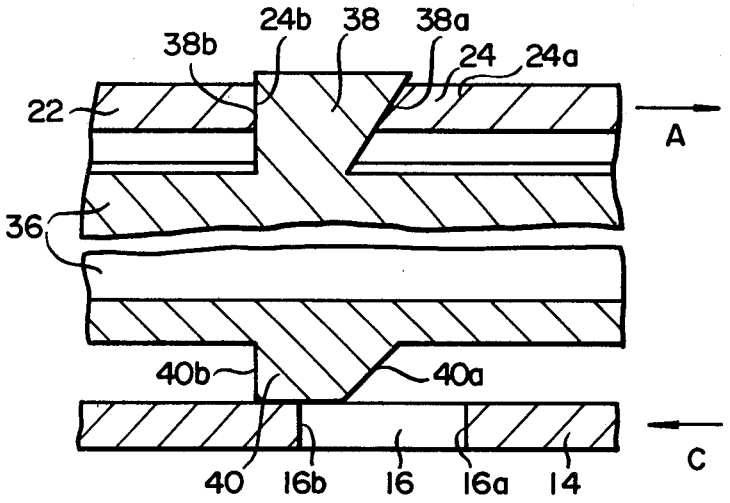
FIGS. 6 through 9 illustrate the operation of the embodiment of the present invention shown in FIG. 1.
Figure 7:
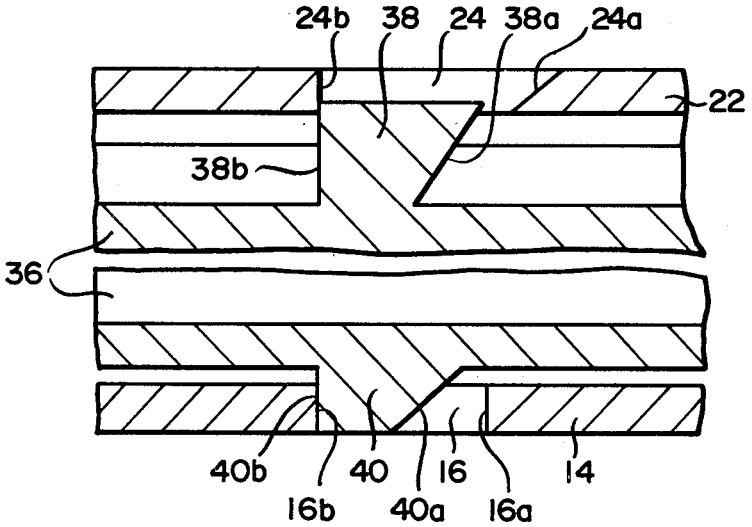

On the other hand, each of the time cam projections 38 of the alarm cam 36 is undercut at one end to form a sloping surface 38*a* facing to the direction shown by arrow A in FIG. 5, that is, to the forward direction. The other end face of the time cam projection 38 defines a vertical surface 38*b*. Each of the time cam apertures 24 in the time wheel 22 is formed with a sloping surface 24*a* at the end face thereof positioned in the direction A while the other end face of the time cam aperture 24 defines a vertical surface 24*b*. The vertical surface 38*b* of the time cam projection 38 normally engages with the vertical surface 24*b* of the time cam aperture 24 so that the alarm cam 36 will be urged by the time wheel 22 in the direction A.

An electrically conductive activating spring 44 and a fixed contact plate 48 are mounted on the mechanism supporting plate 10 and connected to a source of power and an acoustic alarm device through leads all of which are not shown in the drawings. The activating spring 44 urges the alarm cam 36 against the alarm setting wheel 14 at all times. When the alarm pawls 40 and 42 of the alarm cam 36 drops into the corresponding alarm cam apertures 16 and 18 of the alarm setting wheel 14, the contact 46 formed on the activating spring at the free end thereof makes contact with the fixed contact plate 48.

The operation in such an arrangement will now be described. Since the combination of the alarm pawl 40 with the alarm cam aperture 16 is identical with that of the alarm pawl 42 with the alarm cam aperture 18 in operation, only one of these combinations will be described. The existing time can be changed through the conventional external time changing mechanism which engages with the minute hand pinion 28. When the time wheel 22 is rotated through the time changing mechanism in the direction A, the alarm cam 36 is also rotated in the same direction. As the alarm cam 36 continues to rotate, the cam pawl 40 drops into the alarm cam aperture 16. Thereafter, the sloping surface 40*a* of the alarm pawl 40 rides up on the vertical surface 16*a* of the alarm cam aperture 16, so that the alarm pawl 40 disengages from the alarm cam aperture 16. Thus, the time hand can be rotated in the forward direction without any obstruction.

Figure 9:
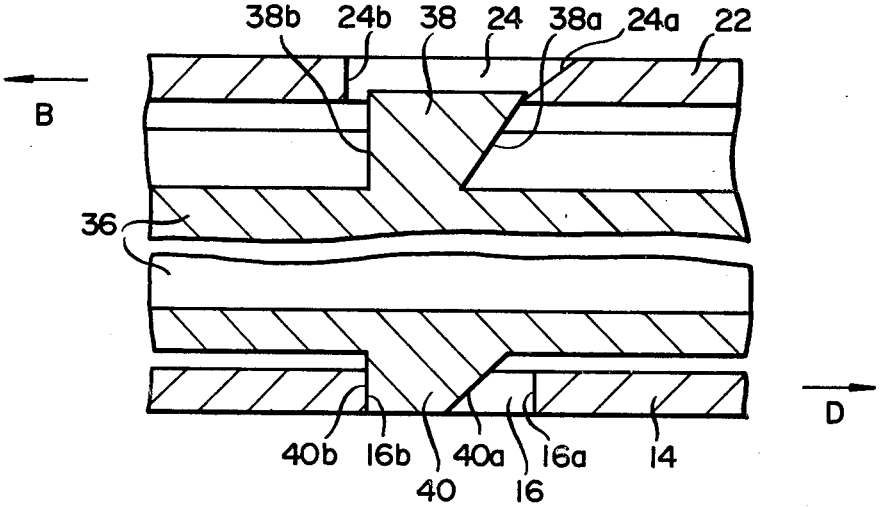

If it is wanted to change the position of the time hand in the reverse direction, the time wheel 22 is rotated in the direction shown by arrow B in FIG. 9. At this time, the sloping surface 38*a* of the time cam projection 38 engages with the sloping surface 24*a* of the time cam aperture 24 at the lower edge thereof so that the alarm cam 36 will rotate with the time wheel 22 as a unit. As the alarm cam 36 continues to rotate, the alarm pawl 40 of the alarm cam 36 drops into the alarm cam aperture 16 of the alarm setting wheel 14. As the vertical surface 16*b* of the alarm cam aperture 16 thereafter engages with the vertical surface 40*b* of the alarm pawl 40, the sloping surface 38*a* of the time cam projection 38 rides up on the sloping surface 24*a* of the time cam aperture 24. As a result, the alarm cam 36 is forced to move upwardly as viewed in FIG. 9 so that the alarm pawl 40 will disengage from the alarm cam aperture 16. Therefore, the alarm cam 36 and the time wheel 22 can be rotated in the direction B without any obstruction. In such a manner, the existing time can be changed by rotating the time hand both in the forward and reverse directions.

Figure 8:
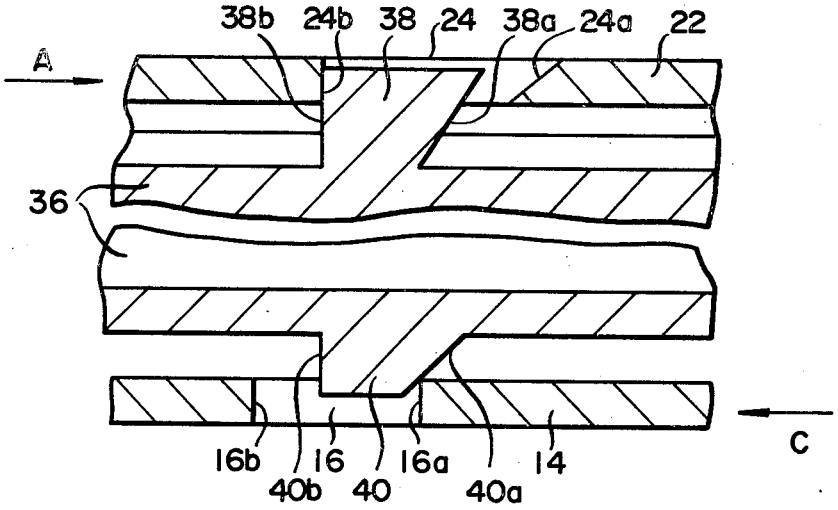

Changes in the alarm setting time will be carried out in the following procedure. The alarm setting wheel 14 is rotated in the direction shown by arrow C in FIG. 8 to rotate the alarm hand in the forward direction. At this time, the vertical surface 38*b* of the time cam projection 38 in the alarm cam 36 is in engagement with the vertical surface 24*b* of the time cam aperture 24. The rotation of the time wheel 22 requires a substantially large torque since it engages with the timepiece gear train (not shown). As the alarm setting wheel 14 continues to rotate in the direction C, the alarm pawl 40 drops into the alarm cam aperture 16. Thereafter, the sloping surface 40*a* of the alarm pawl 40 rides up on the vertical surface 16*a* of the alarm cam aperture 16, so that the alarm cam 36 moves upwardly as viewed in FIG. 8, to disengage the alarm pawl 40 from the alarm cam aperture 16. Thus, the alarm setting wheel 14 can be rotated in the direction C without any obstruction.

When it is desired to rotate the alarm hand in the reverse direction, the alarm setting wheel 14 is rotated in the direction shown by arrow D in FIG. 9. The alarm cam 36 can be rotated in the direction D by the fact that the vertical surface 40*b* of the alarm pawl 40 is urged by the vertical surface 16*b* of the alarm cam aperture 16. As the sloping surface 38*a* of the time cam projection 38 engages with the sloping surface 24*a* of the time cam aperture 24, the time cam projection 38 begins to ride up on the sloping surface 24*a*, so that the alarm cam 36 will move upwardly as viewed in FIG. 9. Thus, the pawl 40 disengages from the alarm cam aperture 16. Accordingly, the alarm setting time can be changed by rotating the alarm hand both in the forward and reverse directions. In such a manner, the alarm setting mechanism according to the present invention does not require a number of parts as would be required in the conventional alarm setting mechanism which includes a ratchet mechanism required to rotate the time or alarm hand only in one direction. In addition, there will be no damage in the gear trains as would be in the conventional alarm setting mechanism when the time or alarm hand is rotated in the reverse direction.

Figure 10:
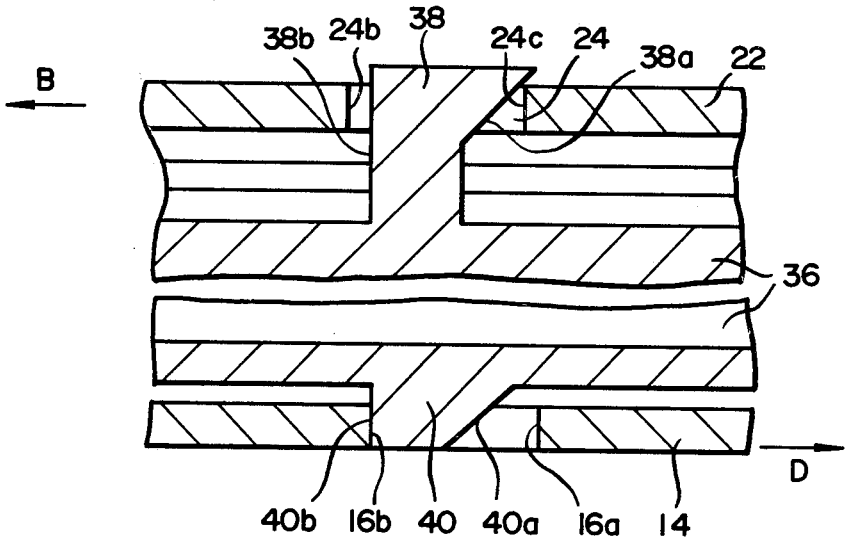
FIG. 10 is a cross-sectional view of a time cam projection which is a modified form in the present invention.

In another embodiment of the present invention, the time cam projection 38 of the alarm cam 36 may extend beyond the supper surface of the time wheel 22 through the time cam aperture 24 therein when the alarm pawl 40 is within the alarm cam aperture 16 as shown in FIG. 10. In such a case, the end face 24*c* of the time cam aperture 24 positioned in the forward direction may be vertical.

In the illustrated embodiments, the time wheel 22 and the alarm setting wheel 14 include the time cam apertures 24 and the alarm cam apertures 16 formed therethrough, respectively. The alarm cam 36 includes the time cam projections 38 and the alarm pawls 40, 42 formed therein. However, the time cam projections 38 and the alarm pawls 40, 42 may be formed in the time wheel 22 and the alarm setting wheel 14, respectively. At the same time, the alarm cam 36 may include the time cam apertures 24 and alarm cam apertures 16, 18 formed therethrough. Even in such an arrangement, the same advantages can be obtained.

Although the time wheel 22 and alarm setting wheel 14 are coaxially disposed relative to the time hand in the illustrated embodiments, these wheels may not coaxially be disposed relative to the time hand. Since the alarm cam 36 is thus disposed about any other axle, the timepiece mechanism can be reduced in thickness by the thickness of the alarm cam 36.

In accordance with the present invention, the alarm cam is disposed between the time wheel and the alarm setting wheel for permitting the alarm cam to move axially. The alarm cam includes the time cam projections formed therein which engage in the time cam apertures formed in the time wheel at all times. Furthermore, the time cam projections have each one sloping end face which permits the time cam projection to ride up on the end face of the corresponding time cam aperture. Thus, only the alarm cam can axially be moved and the alarm setting wheel and alarm cam can be rotated relative to each other both in the opposite directions, so that the existing or alarm setting time can be changed both in the forward and reverse directions. In addition, the time hand will not be displaced during operation of the alarm setting device since both the time wheel and the alarm setting wheel are inhibited from moving axially.

What is claimed is:

1. An alarm setting device for timepieces comprising a time wheel cooperative with the gear train of a timepiece to rotate by one revolution for twelve hours, an alarm setting wheel coaxially disposed with said time wheel for setting any alarm setting time, an alarm cam coaxially disposed between said time wheel and said alarm setting wheel for permitting said alarm cam to rotate about and slide on the axis, and an activating spring urging said alarm cam against said alarm setting wheel, said alarm setting device being characterised by time cam aperture means formed in one of the time wheel face and the alarm setting wheel face opposed to said time wheel, time can projection means formed in the other wheel face for engaging with said time cam aperture means at all times, said time cam projection means including a sloping surface formed therein at one end, said sloping surface making an acute angle with the plane including said alarm cam and being adapted to engage with said time cam aperture means at one end when said time wheel is rotated in the reverse direction, alarm cam aperture formed in one of the alarm setting wheel face and the alarm cam face opposed to said alarm setting wheel, and alarm cam pawl means formed in the other of the alarm setting wheel face and the alarm cam face opposed to said alarm setting wheel for engaging with said alarm cam aperture means, said alarm cam pawl including a sloping surface formed therein at one end which is adapted to engage with said alarm cam aperture means at one end when said alarm cam is rotated in the forward direction, and wherein the sloping surface of said time cam projection means engages with the end of said time cam aperture means to move said alarm cam axially to disengage said alarm cam pawl means from said alarm cam aperture means when said time wheel or alarm setting wheel is rotated in the reverse direction, whereby said time wheel or alarm setting wheel can be rotated both in the forward and reverse directions without any obstruction.

2. An alarm setting device as defined in claim 1 wherein said time cam projection means formed in one of said time wheel and alarm cam extends through said time cam aperture means formed in the other of said time wheel and alarm cam at all times.

3. An alarm setting device as defined in claim 1 wherein said time wheel and alarm setting wheel are mounted on an axle different from the axle of time hand in the timepiece.

* * * * *